US010422560B2

(12) United States Patent
Park et al.

(10) Patent No.: US 10,422,560 B2
(45) Date of Patent: Sep. 24, 2019

(54) EJECTOR AND REFRIGERATION CYCLE APPARATUS INCLUDING EJECTOR

(71) Applicant: LG ELECTRONICS INC., Seoul (KR)

(72) Inventors: Hansaem Park, Seoul (KR); Soojin Kang, Seoul (KR); Dongkeun Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 121 days.

(21) Appl. No.: 15/442,130

(22) Filed: Feb. 24, 2017

(65) Prior Publication Data

US 2017/0356683 A1 Dec. 14, 2017

(30) Foreign Application Priority Data

Jun. 13, 2016 (KR) ..... 10-2016-0073368

(51) Int. Cl.
*F25B 41/00* (2006.01)

(52) U.S. Cl.
CPC ..... *F25B 41/00* (2013.01); *F25B 2341/0011* (2013.01); *F25B 2341/0012* (2013.01)

(58) Field of Classification Search
CPC ..... F25B 41/00; F25B 2341/0012; F25B 2341/0011; F25B 9/08; F25B 2341/001; F25B 1/06; F25B 1/08
(Continued)

(56) References Cited

U.S. PATENT DOCUMENTS

2008/0060378 A1 3/2008 Gocho et al.
2013/0277448 A1* 10/2013 Liu ..... F04F 5/461 239/11
2015/0308462 A1 10/2015 Awa et al.

FOREIGN PATENT DOCUMENTS

CN 103270379 8/2013
CN 104797894 7/2015
(Continued)

OTHER PUBLICATIONS

Kondo, Toshiaki, Ejector, Oct. 2005, European Patent Office, English Translation (Year: 2005).*
(Continued)

*Primary Examiner* — Frantz F Jules
*Assistant Examiner* — Steve S Tanenbaum
(74) *Attorney, Agent, or Firm* — Ked & Associates LLP

(57) ABSTRACT

An ejector and a refrigeration cycle apparatus having an ejector are provided. The ejector may include an ejector body having a suction portion into which a high pressure refrigerant and a low pressure refrigerant may be suctioned, and having a mixing portion provided at one side of the suction portion and configured to mix the high pressure refrigerant with the low pressure refrigerant; a nozzle movably provided in the suction portion, and configured to inject the high pressure refrigerant; a needle inserted into an end of the nozzle and configured to control a flow sectional area of the nozzle; and a nozzle drive configured to drive the nozzle so as to be relatively movable with respect to the mixing portion and the needle. As a flow sectional area of a high pressure refrigerant passage and a flow sectional area of a low pressure refrigerant passage are controlled, a driving efficiency of the ejector may be enhanced.

10 Claims, 17 Drawing Sheets

(58) Field of Classification Search
USPC ..... 62/5
See application file for complete search history.

(56) References Cited

FOREIGN PATENT DOCUMENTS

| | | | | |
|---|---|---|---|---|
| JP | 2005-282507 | | | 10/2005 |
| JP | 2005282507 | A | * | 10/2005 |
| JP | 4120296 | | | 7/2008 |
| JP | 4134931 | | | 8/2008 |
| JP | 4273977 | | | 3/2009 |
| JP | 4367168 | | | 9/2009 |
| WO | WO 2012/092685 | | | 7/2012 |

OTHER PUBLICATIONS

Korean Office Action dated Mar. 9, 2017.
European Search Report dated Oct. 17, 2017 issued in Application No. 17174877.5.
Chinese Office Action dated Apr. 28, 2019 with English Translation.

* cited by examiner

EJECTOR AND REFRIGERATION CYCLE APPARATUS INCLUDING EJECTOR

CROSS-REFERENCE TO RELATED APPLICATION(S)

Pursuant to 35 U.S.C. § 119(a), this application claims priority to Korean Application No. 10-2016-0073368, filed in Korea on Jun. 13, 2016, the contents of which is incorporated by reference herein in its entirety.

BACKGROUND

Field

An ejector and a refrigeration cycle apparatus including an ejector are disclosed herein.

Background

As is well known, a refrigeration cycle apparatus includes a compressor configured to compress a refrigerant, a high pressure side heat exchanger configured to cool the compressed refrigerant, an expansion device configured to depressurize and expand the refrigerant, and an evaporator configured to evaporate the refrigerant as the refrigerant absorbs latent heat. An ejector connected to each of a high pressure side heat exchanger and the evaporator is provided at a part of the refrigeration cycle apparatus.

The ejector used in the refrigeration cycle apparatus is configured to prevent loss occurring during an expansion process by expanding a high pressure refrigerant (main flow), and to reduce power consumption of the apparatus by increasing a pressure of a low pressure refrigerant (suction flow) discharged from an outlet of the evaporator. However, the conventional ejector and the refrigeration cycle apparatus having the same may have the following problems.

As a flow amount of a refrigerant passing through a nozzle is proportional to a sectional area (diameter, inner diameter) of a neck of the nozzle (a discharge side end), the sectional area (diameter, inner diameter) of the neck of the nozzle should be controlled in a sophisticated manner. More specifically, as the diameter of the neck of the nozzle requires precise dimension control so as to have a tolerance of several tens of microns (μm), it is not easy to process and fabricate the nozzle.

Second, even if a flow sectional area of the nozzle is formed through precise dimension control, if a pressure condition, such as a change in thermal load, is changed, an expansion deficiency or over-expansion of a refrigerant occurs. This may lower efficiency of the ejector.

In order to solve such problems, there has been proposed an ejector having a moveable needle capable of controlling a size of a diameter of a neck of a nozzle (a sectional area of a discharge side end of the nozzle), by relatively moving the needle with respect to the nozzle. However, the ejector having such a moveable needle, and a refrigeration cycle apparatus having the same may have the following problems. That is, as a nozzle is in a fixed state, only a diameter of a neck of the nozzle, a factor influencing efficiency of the ejector, may be controlled. In this case, a diameter of a low pressure refrigerant passage (flow path) formed outside of the nozzle, and a distance between the nozzle and a suction part or inlet are not controlled.

BRIEF DESCRIPTION OF THE DRAWINGS

Embodiments will be described in detail with reference to the following drawings in which like reference numerals refer to like elements, and wherein.

DETAILED DESCRIPTION

Figure 1:
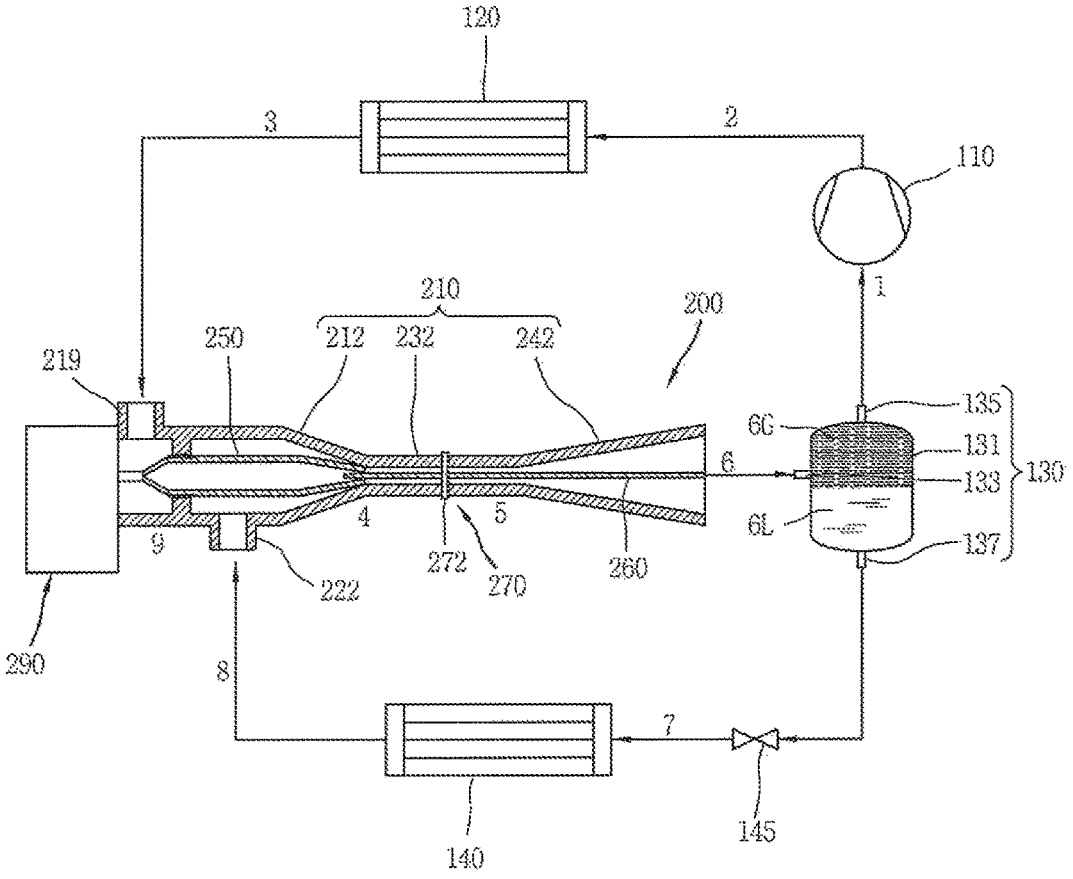
FIG. 1 is a schematic diagram of a refrigeration cycle apparatus having an ejector according to an embodiment.

Hereinafter, embodiments will be explained with reference to the accompanying drawings. Where possible, like or similar reference numerals have been used to indicate like or similar elements, and repetitive disclosure has been omitted. In describing the embodiments, detailed description will be omitted when a specific description for publicly known technologies to which the embodiments pertains is judged to obscure the gist.

Figure 2:
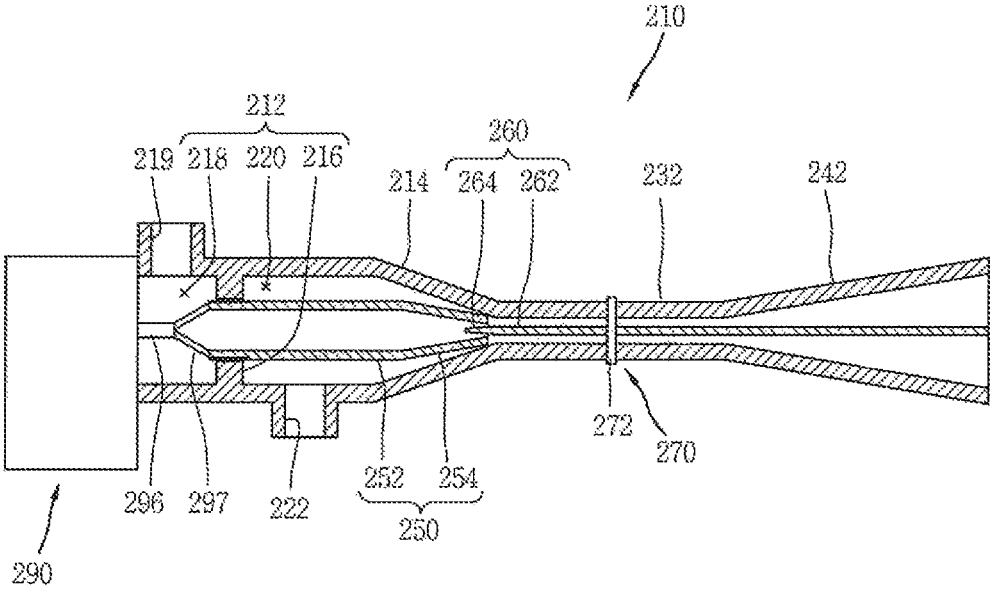
FIG. 2 is an enlarged view of the ejector of FIG. 1.

As shown in FIGS. 1 and 2, a refrigeration cycle apparatus having an ejector according to an embodiment may include a compressor 110 configured to compress a refrigerant; a high pressure side heat exchanger 120 connected to the compressor 110, and configured to cool a high pressure refrigerant; a gas-liquid separator 130 connected to the compressor 110, and configured to separate a refrigerant therein into a gas phase and a liquid phase; an evaporator 140 connected to the gas-liquid separator 130, and configured to evaporate a refrigerant as the refrigerant absorbs latent heat; and an ejector 200 having one or a first side connected to the high pressure side heat exchanger 120 and having another or a second side connected to the evaporator 140. The compressor 110 may suction in and compress a low temperature-low pressure gas refrigerant, and may discharge a high temperature-high pressure refrigerant.

The gas-liquid separator 130 may be connected to a suction side of the compressor 110. For example, the gas-liquid separator 130 may include a hermetic container 131, an inlet 133 through which a refrigerant may be introduced into the hermetic container 131, a first outlet 135 through which the gas refrigerant inside of the hermetic container 131 may be discharged out of the hermetic container 131, and a second outlet 137 through which the liquid refrigerant inside of the hermetic container 131 may be discharged out of the hermetic container 131.

The inlet 133 may be connected to the ejector 200. A refrigerant of two phases where gas and liquid are mixed with each other, discharged from the ejector 200, may be introduced into the hermetic container 131 through the inlet 133. Then, the refrigerant introduced into the hermetic container 131 may be separated into a liquid refrigerant and a gaseous refrigerant. The gas refrigerant inside of the hermetic container 131 may be disposed at or in an upper region of the hermetic container 131, whereas the liquid refrigerant inside of the hermetic container 131 may be disposed at or in a lower region of the hermetic container 131.

The first outlet 135 may be connected to the compressor 110. The gas refrigerant may be suctioned into the compressor 110 via the first outlet 135. The second outlet 137 may be connected to the evaporator 140.

A throttle valve 145, configured to control a flow sectional area of a liquid refrigerant, may be provided between the evaporator 140 and the gas-liquid separator 130. A liquid refrigerant of the gas-liquid separator 130 may be depressurized and expanded after passing through the throttle valve 145. Then, the refrigerant depressurized and expanded after passing through the throttle valve 145 may be evaporated at or in the evaporator 140 by absorbing latent heat. The high pressure side heat exchanger 120 may be connected to a discharge side of the compressor 110.

The ejector 200 may include an ejector body 210 having a suction part or portion 212 into which a high pressure refrigerant and a low pressure refrigerant may be suctioned, and having a mixing part or portion 232 provided at one or a first side of the suction portion 212 and configured to mix the high pressure refrigerant with the low pressure refrigerant; a nozzle 250 movably provided in the suction portion 212, and configured to inject the high pressure refrigerant; a needle 260 inserted into an end of the nozzle 250 and configured to control a flow sectional area of the nozzle 250; and a nozzle driving unit or drive 290 configured to drive the nozzle 250 so as to be relatively moved with respect to the mixing portion 232 and the needle 260.

The ejector body 210 may be provided with therein the suction portion 212 to suction a high pressure refrigerant and a low pressure refrigerant. The suction portion 212 may be provided with a tapered section 214 in which section a flow sectional area of a refrigerant may be reduced in a discharge direction of the high pressure refrigerant.

The mixing portion 232 to mix the high pressure refrigerant and the low pressure refrigerant with each other may be formed at one side of the tapered section 214. The mixing portion 232 may be provided with a pipe shape having a same inner diameter.

A diffuser 242, in which a flow sectional area of refrigerant may be gradually increased, may be provided at one side of the mixing portion 232. A refrigerant introduced into the diffuser 242 from the mixing portion 232 may have a decreased speed and an increased pressure.

A partitioning unit or partition 216, configured to partition an inner space of the suction part 212 into a high pressure refrigerant suction region 218 and a low pressure refrigerant suction region 220, may be formed at the suction portion 212. A high pressure refrigerant suction opening 219 configured to suction a high pressure refrigerant may be formed at the high pressure refrigerant suction region 218. The high pressure refrigerant suction opening 219 may be connected to a discharge side of the high pressure side heat exchanger 120.

A low pressure refrigerant suction opening 222 configured to suction a low pressure refrigerant may be formed at the low pressure refrigerant suction region 220. The low pressure refrigerant suction opening 222 may be connected to a discharge side of the evaporator 140.

An insertion opening 224 configured to receive the nozzle 250 in a relatively moveable manner may be penetratingly-formed at the partition 216. The nozzle 250 may be provided in the ejector body 210 so as to be relatively moveable with respect to the ejector body 210.

The nozzle 250 may include a nozzle body 252 having a pipe shape with a predetermined inner diameter, and a tapered section 254 formed at one side of the nozzle body 252 with an inclination such that a flow sectional area of a refrigerant is gradually decreased. A neck of the nozzle 250, which has a smallest flow sectional area of a refrigerant, may be formed at an end of the tapered section 254 of the nozzle 250. With such a configuration, an injection speed of a high pressure refrigerant through the nozzle 250 may be increased.

The needle 260 may be inserted into a discharge side end of the nozzle 250, so as to control a flow sectional area of the neck of the nozzle 250. The needle 260 may include a needle body 262 having a predetermined diameter, and a tapered section 264 formed at one side of the needle body 262 such that an outer width thereof is gradually decreased.

The needle 260 may be provided in the mixing portion 232. The tapered section 264 of the needle 260 may be inserted into the discharge side end of the nozzle 250, and the needle body 262 may be provided in the mixing portion 232.

A needle supporting unit or support 270 configured to fix and support the needle 260 may be provided at the mixing portion 232. The needle support 270 may be provided with a needle fixing pin 272 coupled to the needle 260 by passing through the mixing portion 232 and the needle 260.

Figure 5:
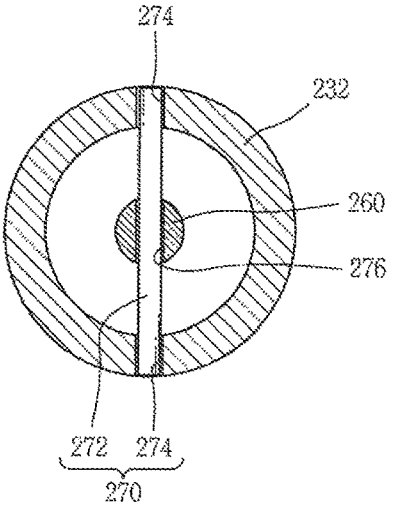
FIG. 5 is a sectional view of a needle support of FIG. 2.

As shown in FIG. 5, the needle support 270 may be provided with a needle fixing pin coupling portion 274 penetratingly-formed at the mixing portion 232 so as to receive-couple the needle fixing pin 272 therein. The needle support 270 may be provided with a needle fixing pin insertion portion 276 penetratingly-formed at the needle 260 so as to insert the needle fixing pin 272 thereinto.

Figure 6:
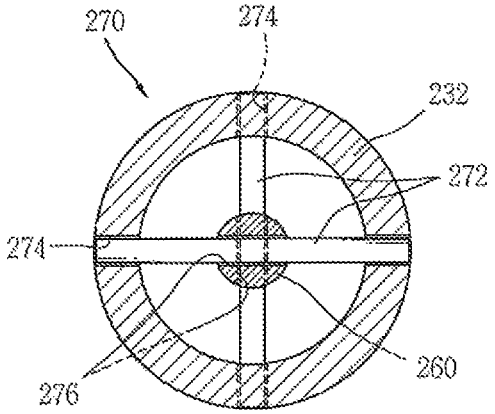
FIG. 6 is a view of a needle support according to another embodiment.

In this embodiment, the needle support 270 is provided with one needle fixing pin 272. However, this is merely exemplary and embodiments are not limited thereto. As shown in FIG. 6, the needle support 270 may be provided with a plurality of needle fixing pins 272. A number of the needle fixing pins 272 may be set based and design constraints and/or the application.

A gap between the nozzle 250 and the mixing portion 232 may be controlled. Each of the nozzle 250 and the needle 260 may be have a predetermined size. For example, the nozzle 250 may be moveable among a plurality of positions.

Figure 3:
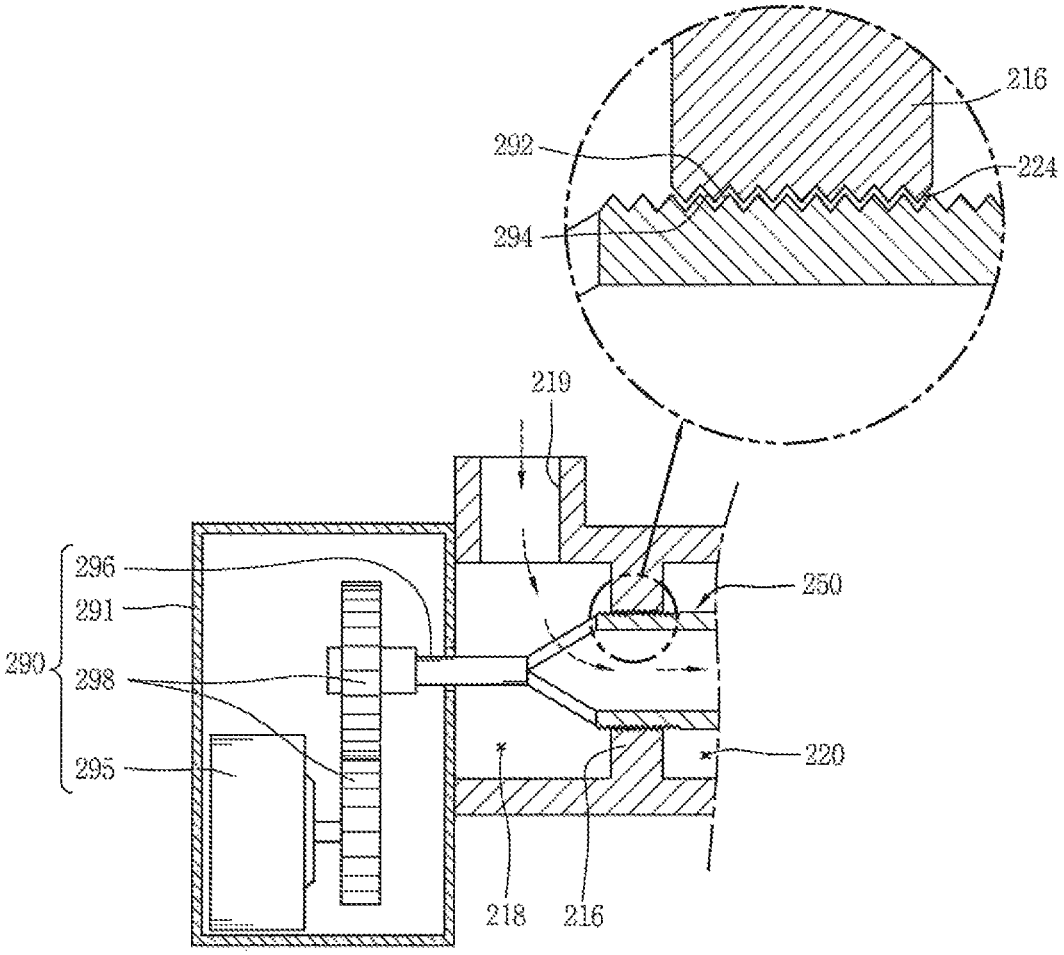
FIG. 3 is an enlarged view of a portion of the ejector of FIG. 2.

The nozzle drive 290 may be provided at one side of the nozzle 250. As shown in FIG. 3, the nozzle drive 290 may include a male screw portion 292 formed on an outer surface of the nozzle 250, a female screw portion 294 provided on an inner surface of the insertion opening 224 and screw-coupled to the male screw portion 292, and a nozzle drive motor 295 configured to rotate the nozzle 250.

The nozzle drive 290 may be provided with a case 291 having an accommodation space therein. The nozzle drive motor 295 may be provided in the case 291.

A drive shaft 296 may be provided at one side of the nozzle 250. The drive shaft 296 may have one or a first end provided in the case 291, and another or a second end outwardly-protruding toward the nozzle 250.

Figure 4:
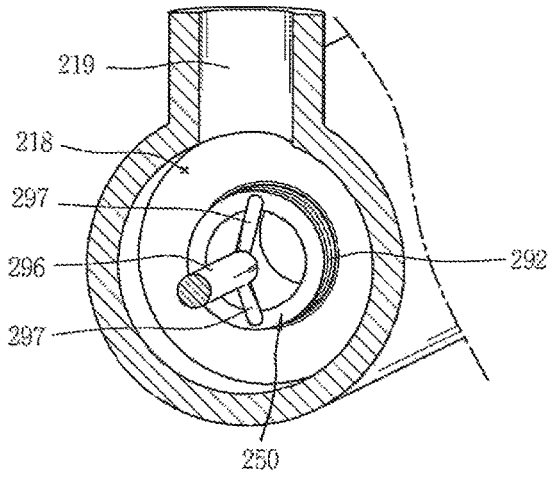
FIG. 4 is a partial cut-out perspective view of an end region of a nozzle shown in FIG. 3.

As shown in FIG. 4, a divergence unit or diverger 297 connected to an end of the nozzle 250 may be formed at the drive shaft 296. In this embodiment, the divergence unit 297 includes two elements. However, this is merely exemplary and embodiments are not limited thereto. That is, the divergence unit 297 may include three or four elements. The nozzle drive motor 295 configured to rotate the drive shaft 296 may be provided at one side of the drive shaft 296. A plurality of power transmission gears 298, rotated by being engaged with each other so as to transmit power, may be provided between the drive shaft 296 and the nozzle drive motor 295.

In this embodiment, the plurality of power transmission gears 298 are provided between the drive shaft 296 and the nozzle drive motor 295. However, alternatively, the drive shaft 296 may be directly connected to a rotational shaft of the nozzle drive motor 295.

The nozzle 250 may be disposed at a different position according to a compression ratio, a critical factor of a refrigeration cycle. The compression ratio may be a ratio of a compression pressure with respect to an evaporation pressure (compression pressure/evaporation pressure). That is, if the compression ratio is categorized into a high compression ratio, a middle compression ratio, and a low compression ratio, the nozzle 250 may be formed to be moveable among a first position corresponding to the high compression ratio, a second position corresponding to the middle compression ratio, and a third position corresponding to the low compression ratio.

Efficiency of the ejector may be increased when a diameter (D1) (a flow sectional area) of the neck of the nozzle 250 is reduced in a high compression ratio condition. For efficiency of the ejector, when the diameter (D1) of the neck of the nozzle 250 is reduced, a diameter (D2) (a flow sectional area) of a low pressure refrigerant passage (flow path) formed outside of the nozzle 250 may be reduced proportionally. The diameter (D1) of the neck of the nozzle 250, and the diameter (D2) of the low pressure refrigerant passage formed outside of the nozzle 250 may have a positive (+) correlation. In the high compression ratio condition, an interval (D3) between the nozzle 250 and the mixing portion 232 may be reduced, for enhanced efficiency of the ejector more than a predetermined value.

Figure 7:
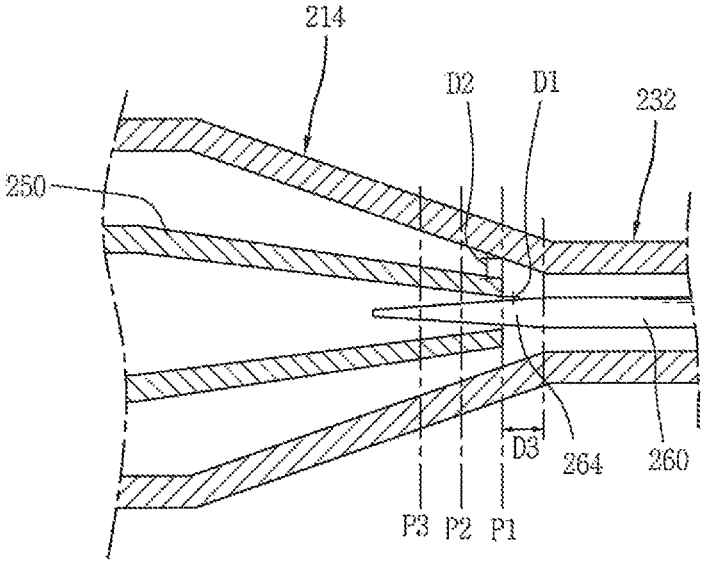
FIG. 7 is a view illustrating a first position of a nozzle shown in FIG. 2.
Figure 8:
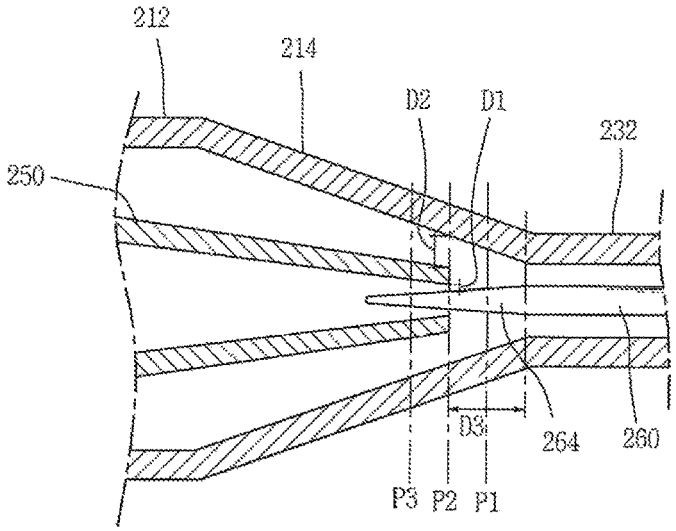
FIG. 8 is a view illustrating a second position of the nozzle shown in FIG. 2.
Figure 9:
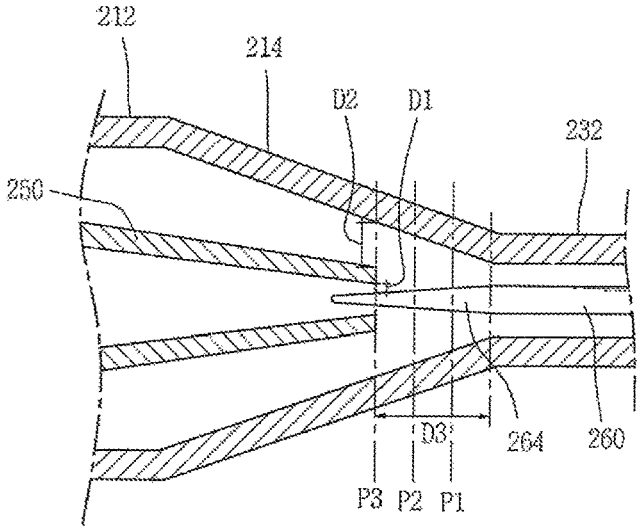
FIG. 9 is a view illustrating a third position of the nozzle shown in FIG. 2.

As shown in FIG. 7, a first position (P1) of the nozzle 250 may be a position at which the nozzle 250 is closest to the mixing portion 232 among the first to third positions. As shown in FIG. 8, a second position (P2) may be a position spaced from the first position toward the suction portion 212 by a predetermined distance. As shown in FIG. 9, the third position (P3) may be a position spaced from the second position toward the suction portion 212 by a predetermined distance.

With such a configuration, the flow sectional area of the neck of the nozzle 250 may have a smallest size at the first position (P1), and may have a largest size at the third position (P3). The flow sectional area of the neck of the nozzle 250 may have an intermediate size between the smallest size at the first position (P1) and the largest size at the third position (P3), at the second position (P2).

In this embodiment, the nozzle 250 is moveable to the three positions. However, this is merely exemplary and embodiments are not limited thereto. That is, a number of positions of the nozzle 250 may be four or more, in a more sub-divided manner, for example.

Figure 11:
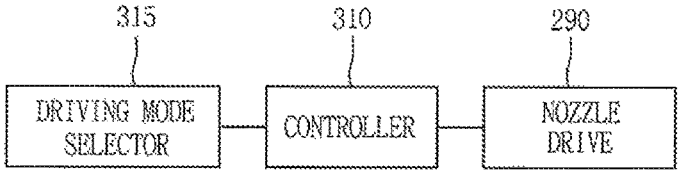
FIG. 11 is a control block diagram of the refrigeration cycle apparatus shown in FIG. 1.

As shown in FIG. 11, the refrigeration cycle apparatus having the ejector may be provided with a controller 310 configured to control a position of the nozzle 250 according to a compression ratio condition. A drive mode selection unit or selector 315 configured to select a drive mode may be connected to the controller 310 in a communicable manner. The nozzle drive 290, configured to move the nozzle 250 to a preset or predetermined position according to a drive mode selected by the drive mode selector 315, may be connected to the controller 310 so as to be controllable.

The drive mode may be categorized according to a compression ratio or a refrigeration load amount. That is, the drive mode may include a first mode in which a compression ratio or a refrigeration load amount is large, a third mode in which a compression ratio or a refrigeration load amount is smaller than that of the first mode, and a second mode in which a compression ratio or a refrigeration load amount is intermediate between that of the first mode and that of the third mode.

For example, the controller 310 may control the nozzle drive 290 such that the nozzle 250 may be positioned at the first position when the first mode is selected. The controller 310 may control the nozzle drive 290 such that the nozzle 250 may be positioned at the second position when the second mode is selected. Also, the controller 310 may control the nozzle drive 290 such that the nozzle 250 may be positioned at the third position when the third mode is selected.

Figure 10:
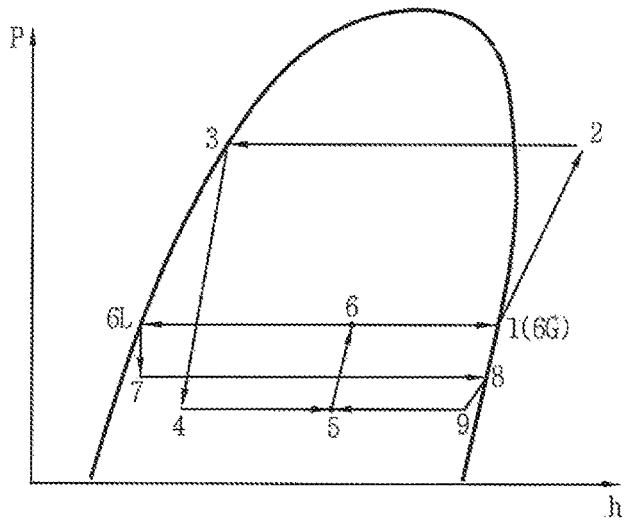
FIG. 10 is a graph illustrating a relation between a pressure and an enthalpy of the refrigeration cycle apparatus shown in FIG. 1.

With such a configuration, referring to FIGS. 1 and 10, when the compressor 110 starts to be driven, a low temperature-low pressure gas refrigerant of the gas-liquid separator 130 (state ①, refer to 6G of FIG. 10) may be suctioned into the compressor 110 to be compressed, and the compressed high temperature-high pressure refrigerant may be discharged (state ②). The refrigerant discharged from the compressor 110 may be cooled and then discharged from the high pressure side heat exchanger 120 (state ③).

The liquid refrigerant of the gas-liquid separator 130 (refer to 6L of FIG. 10) may be depressurized and expanded after passing through the throttle valve 145 (state ⑦). The refrigerant having passed through the throttle valve 145 may be introduced into the evaporator 140, and may be evaporated in the evaporator 140 by absorbing latent heat and then discharged (state ⑧).

If a first drive mode is selected by the drive mode selector 315, the controller 310 may control the nozzle drive 290 such that the nozzle 250 may be positioned at the first position. A high pressure refrigerant having passed through the high pressure side heat exchanger 120 may be suctioned into the high pressure refrigerant suction region 218 through the high pressure refrigerant suction opening 219. Then, the refrigerant suctioned to the high pressure refrigerant suction region 218 may be discharged out (depressurized and expanded) after passing through the inside of the nozzle 250 (state ④).

In this case, as the nozzle 250 is disposed at the first position, the diameter (D1) (flow sectional area) of the neck of the nozzle 250, formed between the nozzle 250 and the needle 260, may have a relatively small size. The diameter (D2) of the low pressure refrigerant passage (flow sectional area) may also have a relatively small size. Further, the interval (D3) between the nozzle 250 and the mixing portion 232 may be relatively narrow.

With such a configuration, the amount of high pressure refrigerant injected through the nozzle 250, and the amount of low pressure refrigerant injected through the nozzle 250 may be reduced, and deficiency of expansion may be prevented. This may enhance efficiency of the ejector.

The refrigerant having passed through the nozzle 250 may be depressurized and expanded (state ④). The refrigerant having passed through the evaporator 140 may be suctioned into the suction portion 212 through the low pressure refrigerant suction opening 222 (state ⑨), thereby being mixed with the refrigerant having passed through the nozzle 250 and becoming depressurized and cooled (state ⑤).

A refrigerant inside of the mixing portion 232 may be introduced into the diffuser 242, thereby having a reduced speed and an increased pressure (state ⑥). The refrigerant inside of the mixing portion 232 may be introduced into the gas-liquid separator 130.

The refrigerant introduced into the gas-liquid separator 130 may be separated into a gas refrigerant and a liquid refrigerant. Then, the gas refrigerant discharged through the first outlet 135 may be suctioned into the compressor 110 to be compressed and discharged, repeatedly. The liquid refrigerant which has moved through the second outlet 137 may be depressurized and expanded after passing through the throttle valve 145, and may be evaporated at the evaporator 140 by absorbing latent heat.

In this embodiment, the drive mode may be categorized into the first to third modes, and the nozzle 250 may be moveable to one of the first to third positions according to one of the first to third modes. However, this is merely exemplary and embodiments are not limited thereto. That is, a number of the drive modes, and positions of the nozzle 250 corresponding to the number of drive modes may be set based on design constraints and/or the application.

Figure 12:
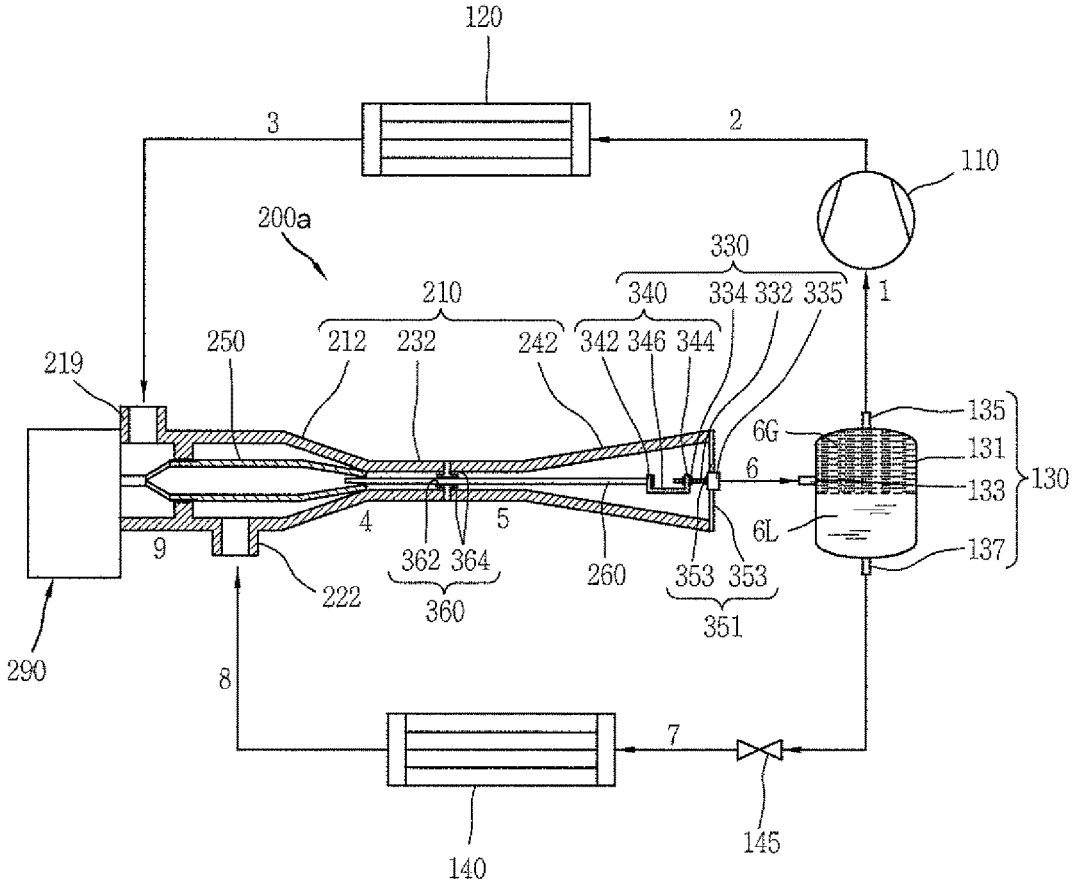
FIG. 12 is a schematic diagram of a refrigeration cycle apparatus having an ejector according to another embodiment.
Figure 13:
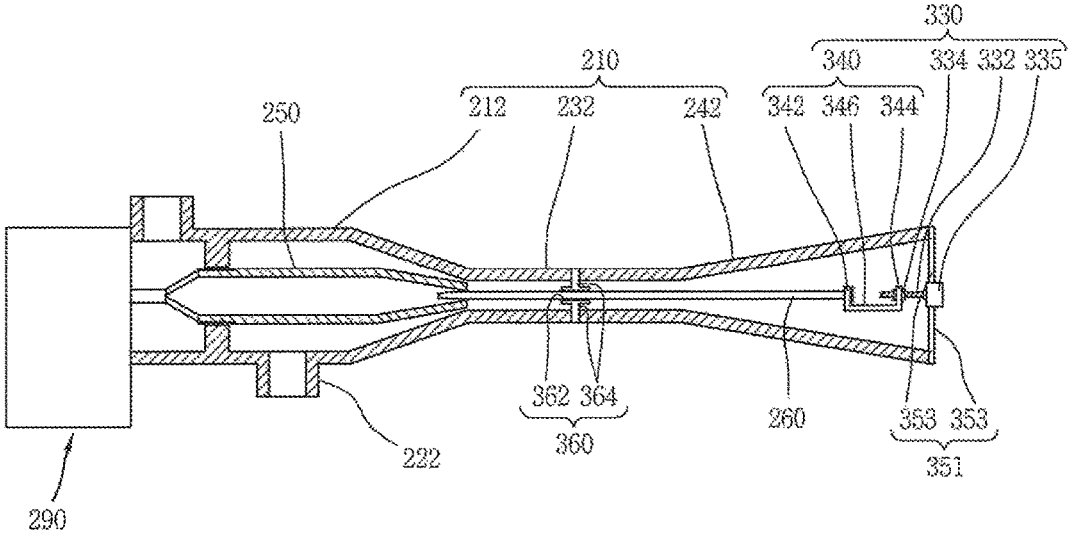
FIG. 13 is an enlarged view of the ejector of FIG. 12.

Hereinafter, another embodiment will be explained with reference to FIGS. 12 to 21. As shown in FIGS. 12 and 13, a refrigeration cycle apparatus having an ejector according to another embodiment may include compressor 110 configured to compress a refrigerant; high pressure side heat exchanger 120 connected to the compressor 110, and configured to cool a high pressure refrigerant; gas-liquid separator 130 connected to the compressor 110, and configured to separate a refrigerant therein into a gas refrigerant and a liquid refrigerant; evaporator 140 connected to the gas-liquid separator 130, and configured to evaporate a refrigerant as the refrigerant absorbs latent heat; and an ejector 200*a* having one or a first side connected to the high pressure side heat exchanger 120, and having another or a second side connected to the evaporator 140. Throttle valve 145 may be provided between the gas-liquid separator 130 and the evaporator 140.

The ejector 200*a* according to this embodiment may include ejector body 210 having suction portion. 212 into which a high pressure refrigerant and a low pressure refrigerant may be suctioned, and having mixing portion 232 provided at one side of the suction portion 212 and configured to mix the high pressure refrigerant with the low pressure refrigerant; nozzle 250 movably provided in the suction portion 212, and configured to inject the high pressure refrigerant; needle 260 inserted into the end of the nozzle 250 and configured to control a flow sectional area of the nozzle 250; nozzle drive 290 configured to drive the nozzle 250 so as to be relatively moved with respect to the mixing portion 232; and a needle drive unit or drive 330 configured to drive the needle 260 so as to be relatively moved with respect to the mixing portion 232. The ejector body 210 may be provided with diffuser 242 extending from one side of the mixing portion 232.

Partition 216, configured to partition the inner space of the suction portion 212 into high pressure refrigerant suction region 218 and low pressure refrigerant suction region 220, may be formed at the suction portion 212. The suction portion 212 may be provided with tapered section 214, an inner diameter of which may gradually be reduced toward the mixing portion 232 (discharge side).

The nozzle 250 may be provided in the suction portion 212 so as to be relatively moveable with respect to the suction portion 212. Insertion opening 224 configured to receive the nozzle 250 in a relatively moveable manner may be provided at the partition 216.

The nozzle drive 290, configured to drive the nozzle 250 so as to be relatively movable with respect to the mixing portion 232, may be formed at one side of the nozzle 250. The nozzle drive 290 may include male screw portion 292 formed on or at the outer surface of the nozzle 250, female screw portion 294 provided on or at the inner surface of the insertion opening 224 and screw-coupled to the male screw portion 292, and nozzle drive motor 295 configured to rotate the nozzle 250.

The needle 260 may be provided in the mixing portion 232 so as to be relatively moveable. The needle 260 may be provided with tapered section 264 formed such that its outer width gradually decreases toward the nozzle 250.

Figure 14:
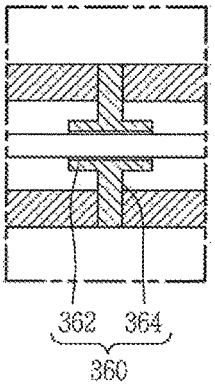
FIG. 14 is an enlarged view of a needle support of FIG. 13.

A needle supporting unit or support 360 configured to support the needle 260 so as to be relatively moveable may be provided in the mixing portion 232. As shown in FIG. 14, the needle support 360 may include a needle accommodation portion 362 configured to accommodate therein the needle 260 so as to be relatively moveable, and a supporting or support 364 configured to support the needle accommodation portion 362.

The needle accommodation portion 362 may be disposed or provided at a middle region of the mixing portion 232. One end of the support 364 may be connected to the needle accommodation portion 362, and another or a second end of the support 364 may be connected to the mixing part 232.

Figure 15:
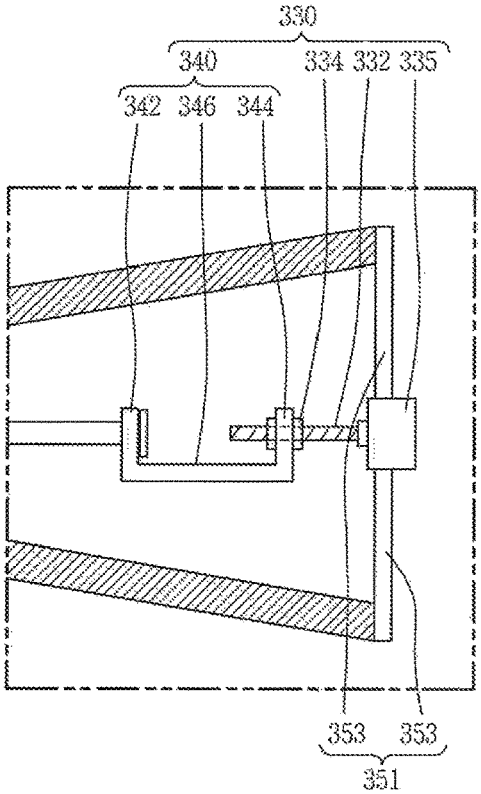
FIG. 15 is an enlarged view of a needle drive of FIG. 13.

As shown in FIG. 15, the needle drive 330 may include a lead screw 332 that extends in a moving direction of the needle 260, a female screw portion 334 screw-coupled to the lead screw 332, and a needle drive motor 335 configured to rotate the lead screw 332. The lead screw 332 may be disposed or provided at one side of the needle 260.

The needle drive motor 335 may be connected to an end of the lead screw 332. For example, the needle drive 330 may further include a power transmission unit or transmission 340 configured to transmit power to the needle 260 by connecting the female screw portion 334 and the needle 260 with each other. The lead screw 332 may be spaced from the needle 260 by a predetermined distance, in a lengthwise direction of the needle 260. The power transmission 340 may be formed to have a 'U' shape. The needle 260 may be connected to one or a first end of the power transmission 340. The lead screw 332 may be connected to another or a second end of the power transmission 340, so as to be relatively moveable with respect to the power transmission 340.

For example, the power transmission 340 may include a needle coupling portion 342, to which the needle 260 may be coupled, a lead screw coupling portion 344, to which the lead screw 332 may be coupled, and a connection portion 346 configured to connect the needle coupling portion 342 with the lead screw coupling portion 344. The female screw portion 334, to which the lead screw 332 may be screw-coupled, may be provided at the power transmission 340. For example, the female screw portion 334 may be provided at the lead screw coupling portion 344. When the lead screw 332 is rotated, the female screw portion 334 may be relatively moved, and thus, the needle 260 may be relatively moved.

The needle drive motor 335 may be provided at the diffuser 242. The diffuser 242 may be provided with a needle drive motor supporting unit or support 351 configured to fix and support the needle drive motor 335. The needle drive motor support 351 may be provided with a plurality of support rods 353, each having one or a first end connected to the needle drive motor 335 and another or a second end connected to the diffuser 242.

Figure 22:
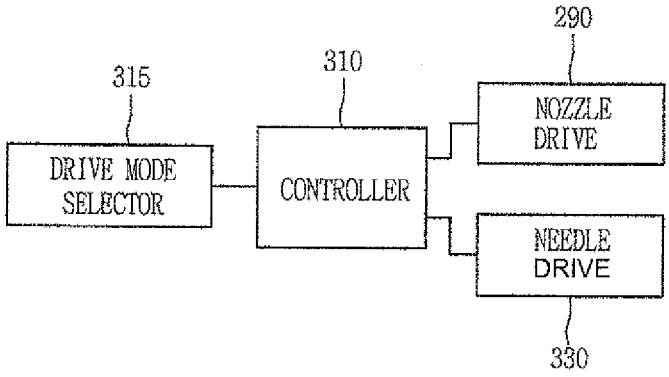
FIG. 22 is a control block diagram of the refrigeration cycle apparatus shown in FIG. 12.

As shown in FIG. 22, the refrigeration cycle apparatus having an ejector according to this embodiment may include a controller 310, which may be a micro processor provided with a control program, for example. The controller 310 may be configured to control each of the nozzle drive 290 and the needle drive 330, based on a drive mode according to a refrigerant compression ratio.

A drive mode selection unit or selector 315 configured to select one of a plurality of drive modes may be connected to the controller 310 in a communicable manner. For example, when a refrigerant compression ratio is increased, the controller 310 may control the nozzle drive 290 such that the nozzle 250 may be moved toward the mixing portion 232. When a refrigerant compression ratio is increased, the controller 310 may control the needle drive 330 such that the needle 260 may be moved in a direction that a diameter or flow sectional area of a discharge side end of the nozzle 250 is reduced.

The drive mode may be classified into a plurality of drive modes based on the refrigerant compression ratio, a ratio of a compression pressure with respect to an evaporation pressure (compression pressure/evaporation pressure). That is, the drive mode may include a first mode to select a high compression ratio of a refrigerant, a second mode to select an intermediate compression ratio lower than the high compression ratio, and a third mode to select a low compression ratio lower than the intermediate compression ratio.

Figure 16:
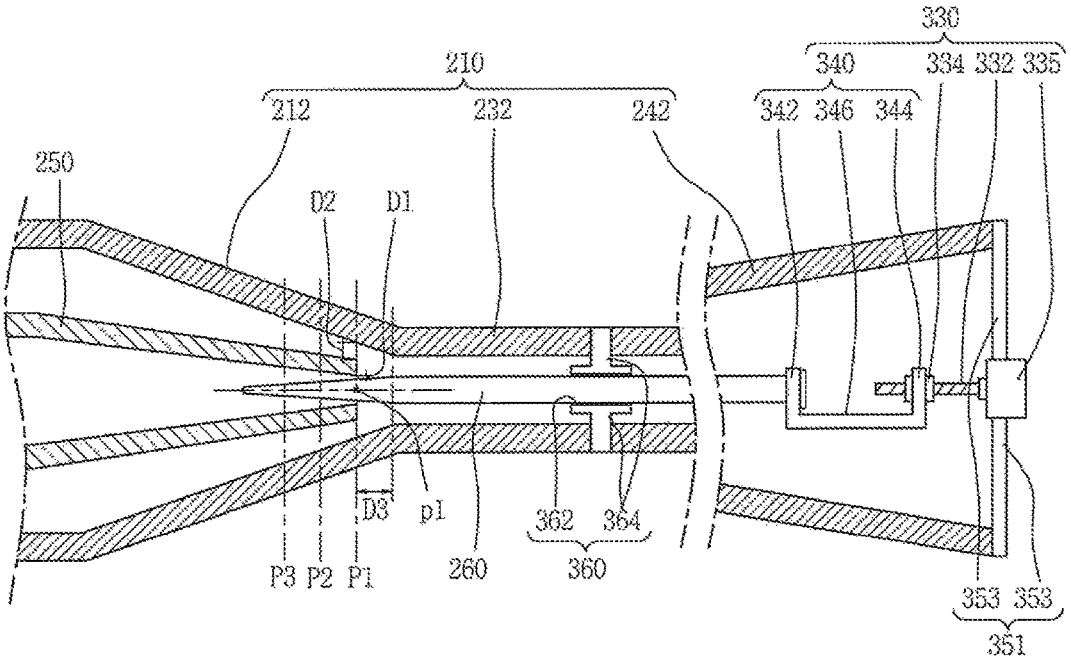
FIG. 16 is a view illustrating a first position of a nozzle of FIG. 13, and a first position of a needle of FIG. 13.
Figure 17:
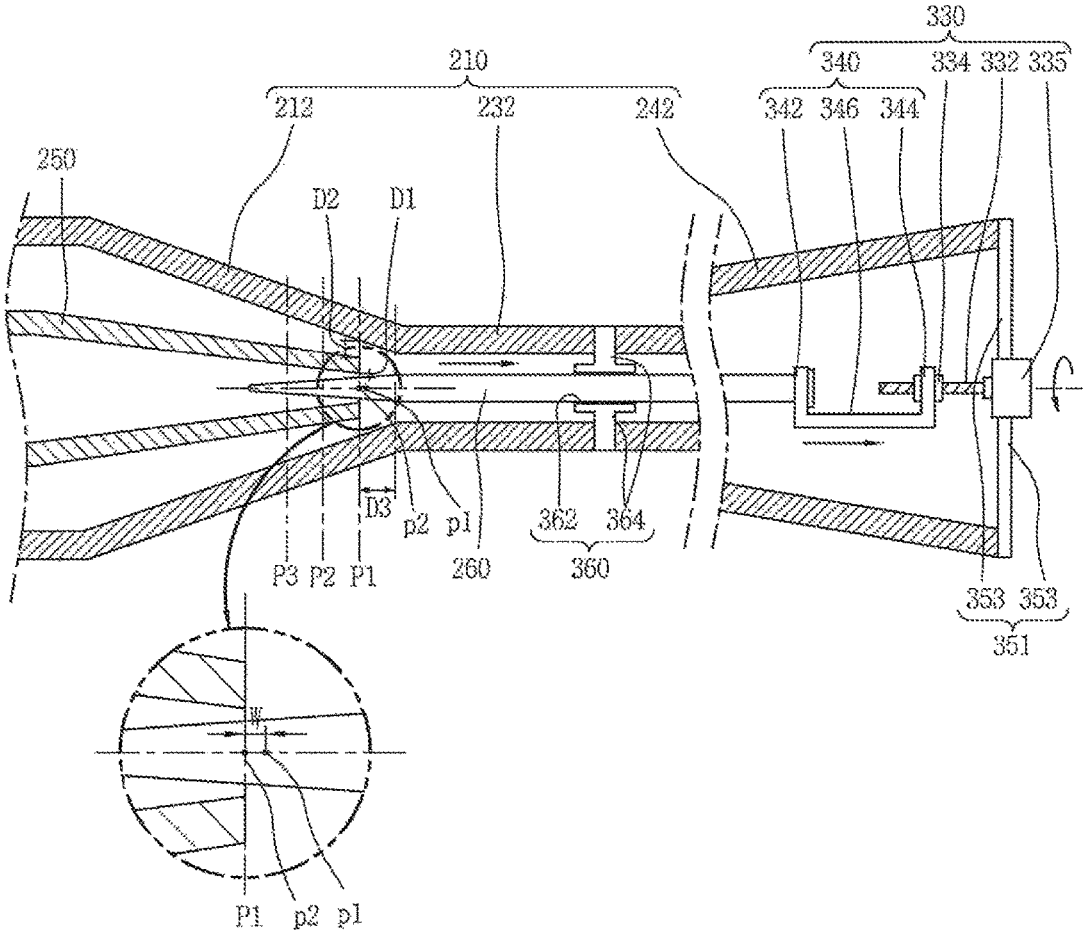
FIG. 17 is a view illustrating the first position of the nozzle of FIG. 16, and a second position of the needle of FIG. 16.
Figure 18:
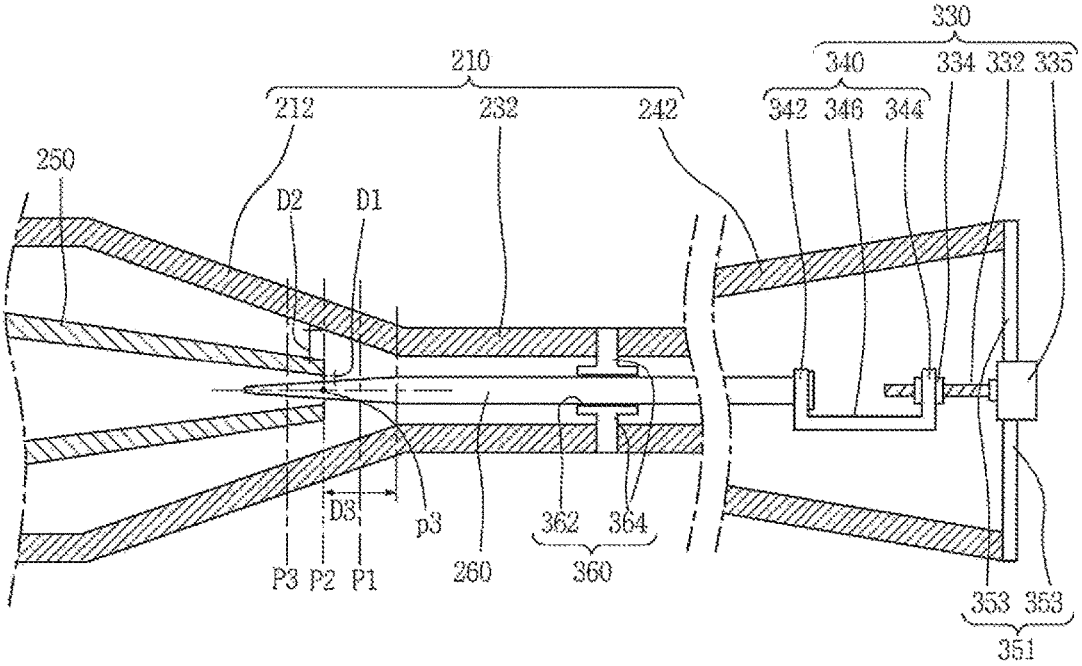
FIG. 18 is a view illustrating a second position of the nozzle of FIG. 13, and a third position of the needle of FIG. 13.
Figure 19:
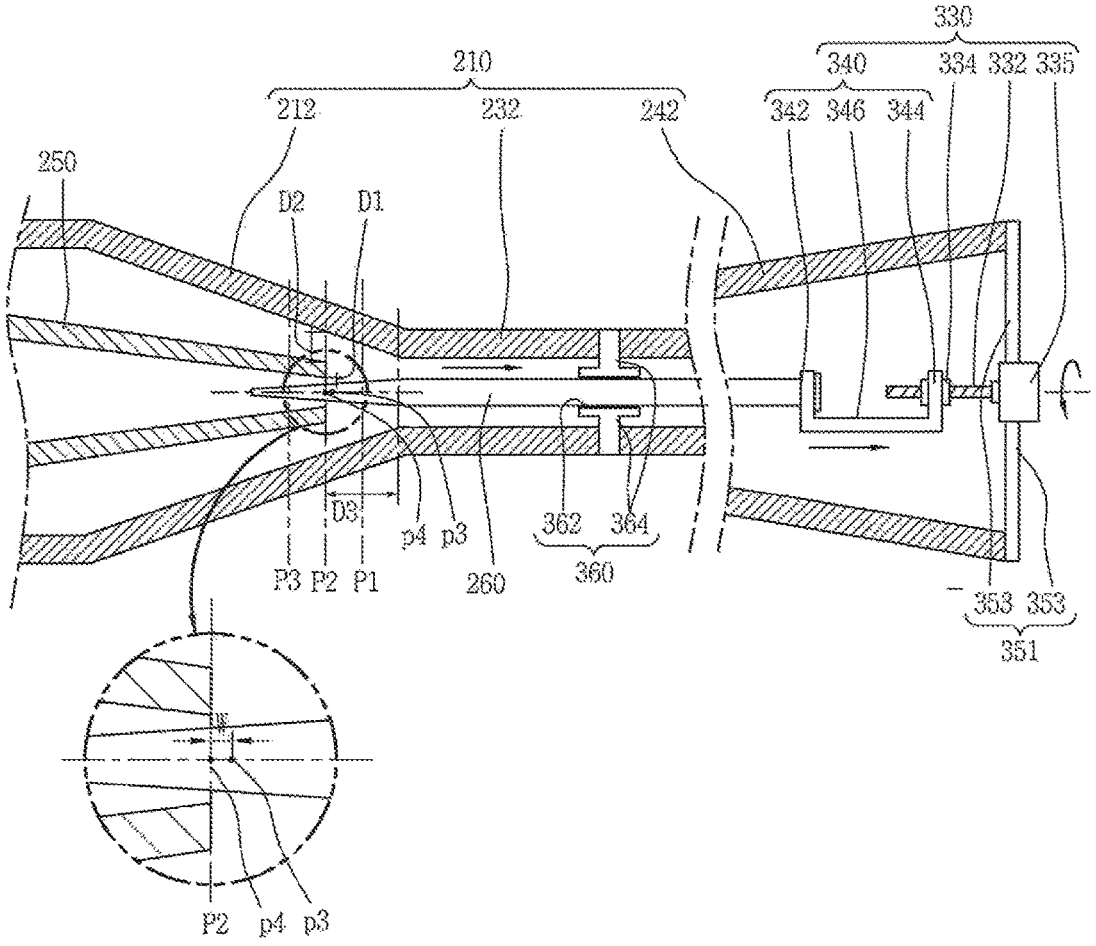
FIG. 19 is a view illustrating the second position of the nozzle of FIG. 18, and a fourth position of the needle of FIG. 18.
Figure 20:
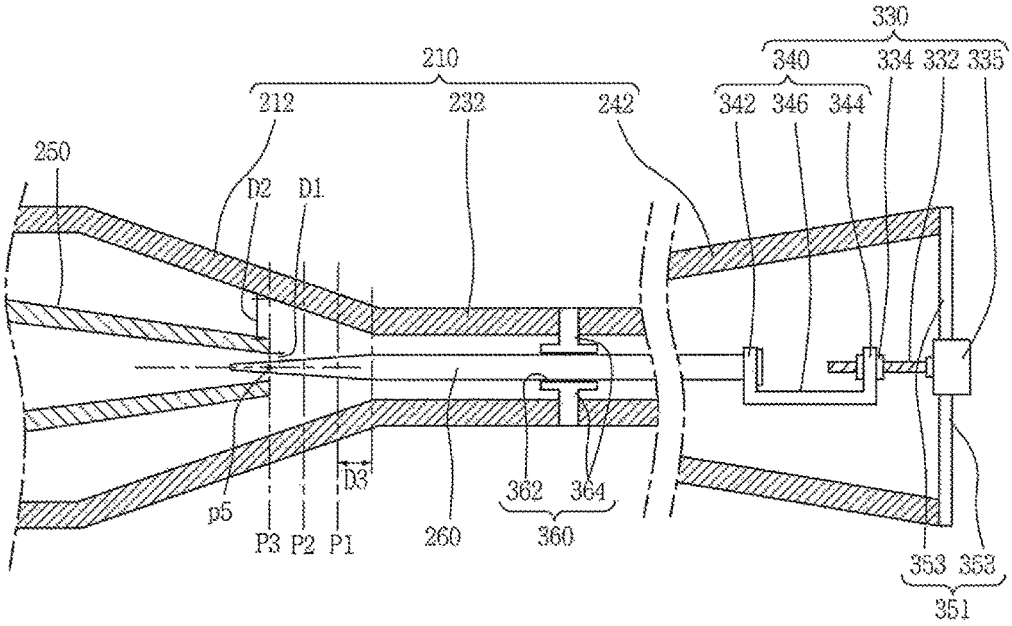
FIG. 20 is a view illustrating a third position of the nozzle of FIG. 13, and a fifth position of the needle of FIG. 13.
Figure 21:
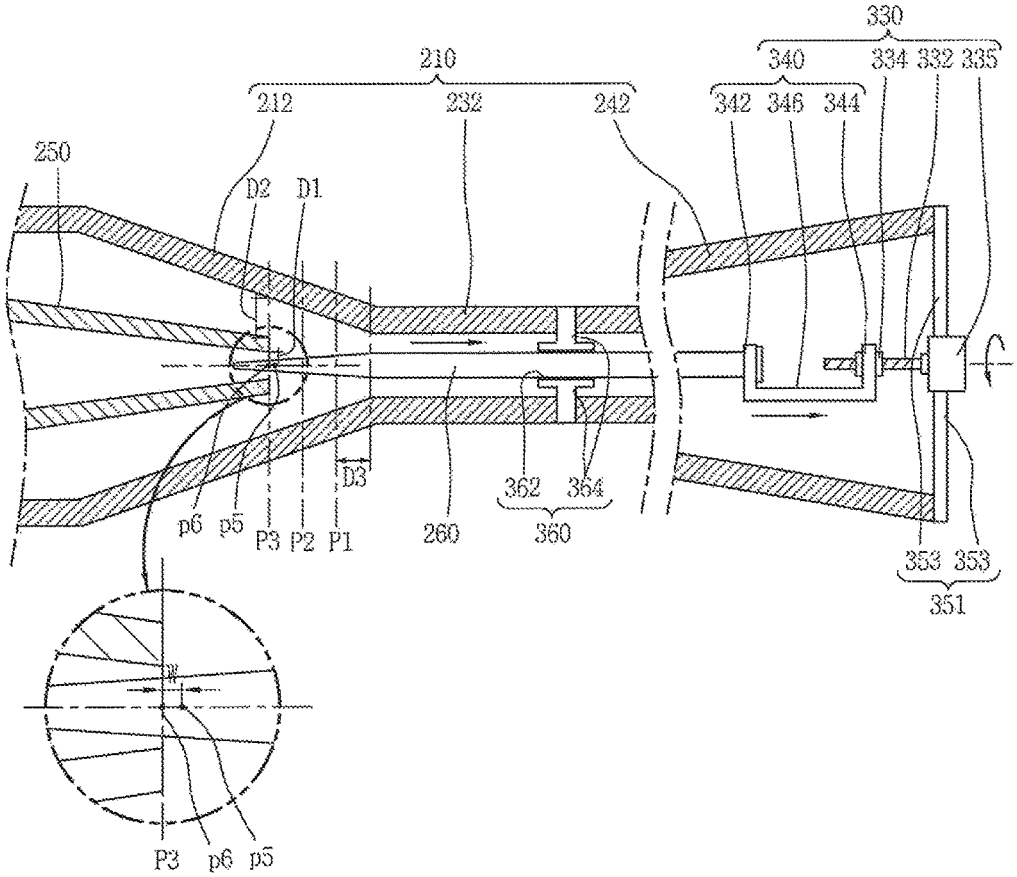
FIG. 21 is a view illustrating the third position of the nozzle of FIG. 20, and a sixth position of the needle of FIG. 20.

As shown in FIGS. 16 and 17, when the first mode is selected, the controller 310 may control the nozzle drive 290 such that the nozzle 250 may be disposed at first position (P1) spaced from the mixing portion 232 by a predetermined distance. As shown in FIGS. 18 and 19, when the second mode is selected, the controller 310 may control the nozzle drive 290 such that the nozzle 250 may be disposed at second position (P2) spaced from the first position (P1) toward the suction portion 212 by a predetermined distance. As shown in FIGS. 20 and 21, when the third mode is selected, the controller 310 may control the nozzle drive 290 such that the nozzle 250 may be disposed at third position (P3) spaced from the second position (P2) toward the suction portion 212 by a predetermined distance.

When the nozzle 250 is disposed at the first position (P1), the controller 310 may control the needle drive 330 such that the needle 260 may be disposed at a first position (p1) where a flow sectional area of the neck of the nozzle 250 is the smallest (refer to FIG. 16). When the nozzle 250 is disposed at the first position (P1), the controller 310 may control the needle drive 330 such that the needle 260 may be disposed at a second position (p2) spaced from the first position (p1) by a predetermined interval (W) where a flow sectional area of the neck of the nozzle 250 is larger than when the needle 260 is at the first position (p1), by a predetermined size (refer to FIG. 17).

The controller 310 may control the needle drive 330 such that the needle 260 may be moved (to the right in the drawing) in order for a flow sectional area between the needle 260 and the nozzle 250 to be increased to a preset or predetermined size.

With such a configuration, when the first mode is selected by the drive mode selector 315, the controller 310 may control the nozzle drive 290 and the needle drive 330 such that the nozzle 250 and the needle 260 may be disposed at the first positions (P1, p1), respectively. If a ratio of a compression pressure with respect to an evaporation pressure (compression pressure/evaporation pressure) is lowered to have a preset or predetermined size during driving, the controller 310 may control the needle drive 330 such that the needle 260 may be moved to the second position (p2). This may prevent degradation of efficiency due to over-expansion of a refrigerant.

As shown in FIG. 18, when the nozzle 250 is disposed at the second position (P2), the controller 310 may control the needle drive 330 such that the needle 260 may be disposed at a third position (p3) where a flow sectional area of the neck of the nozzle 250 is larger than when the needle is at the second position (p2), by a predetermined size. As shown in FIG. 19, when the nozzle 250 is disposed at the second position (P2), the controller 310 may control the needle drive 330 such that the needle 260 may be disposed at a fourth position (p4) spaced from the third position (p3) by a predetermined interval (W) where a flow sectional area of the neck of the nozzle 250 is larger than when the needle 260 is at the third position (p3), by a predetermined size.

As shown in FIG. 20, when the nozzle 250 is disposed at the third position (P3), the controller 310 may control the needle drive 330 such that the needle 260 may be disposed at a fifth position (p5) where a flow sectional area of the neck of the nozzle 250 is larger than when the needle 260 is at the fourth position (p4), by a predetermined size. As shown in FIG. 21, when the nozzle 250 is disposed at the third position (P3), the controller 310 may control the needle drive 330 such that the needle 260 may be disposed at a sixth position (p6) spaced from the fifth position (p5) by a predetermined interval (W) where a flow sectional area of the neck of the nozzle 250 is larger than when the needle 260 is at the fifth position (p5), by a predetermined size.

With such a configuration, the controller 310 may control the diameter (D1) of the neck of the nozzle 250 (flow sectional area), the diameter (02) of the low pressure refrigerant passage outside of the nozzle 250 (flow sectional area), and the interval (D3) between the nozzle 250 and the mixing portion 232, respectively. This may prevent over-expansion or expansion deficiency of a refrigerant, thereby enhancing efficiency of the ejector 200.

In this embodiment, the nozzle may be disposed at one of the first to third positions (P1~P3). However, this is merely exemplary and embodiments are not limited thereto. That is, the number of positions of the nozzle 250 may be four or more, in a more sub-divided manner, for example.

In this embodiment, the needle 260 is moveable to two positions with respect to each position of the nozzle 250. However, this is merely exemplary and embodiments are not limited thereto. That is, the number of positions of the needle 260 may be three or more, in a more sub-divided manner for micro-control, for example.

As discussed above, according to embodiments, the nozzle may be provided in the ejector body so as to be relatively moveable, the nozzle drive may be configured to relatively drive the nozzle with respect to the mixing portion, and the needle is provided. Thus, a flow sectional area of a high pressure refrigerant passage and a flow sectional area of a low pressure refrigerant passage may be controlled. This may enhance a driving efficiency of the ejector. Further, a gap between the nozzle and the mixing portion may be controlled.

Further, as the nozzle and the needle may be independently driven, a flow sectional area of the nozzle, the flow sectional area of the low pressure refrigerant passage, and the gap between the nozzle and the mixing portion may be controlled, respectively. This may allow the ejector to be used commonly.

With such a configuration, a mold for fabricating the ejector, processing equipment, and fabricating equipment may be shared. Further, a time taken to produce the ejector may be shortened, and fabrication costs of the ejector may be reduced. Furthermore, as the flow sectional area of the nozzle, the flow sectional area of the low pressure refrigerant passage, and the gap between the nozzle and the mixing portion may be controlled, the driving efficiency may be enhanced.

Embodiments disclosed herein provide an ejector capable of controlling a flow sectional area of a high pressure refrigerant passage and a flow sectional area of a low pressure refrigerant passage, and a refrigeration cycle apparatus having an ejector. Embodiments disclosed herein further provide an ejector capable of controlling an interval between a nozzle and a mixing portion, and a refrigeration cycle apparatus having an ejector. Embodiments disclosed herein also provide an ejector capable of driving each of a nozzle and a needle, and a refrigeration cycle apparatus having an ejector.

Embodiments disclosed herein provide an ejector that may include an ejector body having a suction part or portion into which a high pressure refrigerant and a low pressure refrigerant may be suctioned, and having a mixing part or portion provided at one side of the suction part and configured to mix the high pressure refrigerant with the low pressure refrigerant; a nozzle provided in the suction part so as to be moveable, and configured to inject the high pressure refrigerant; a needle inserted into an end of the nozzle, and configured to control a flow sectional area of the nozzle; and a nozzle drive unit or drive configured to drive the nozzle so as to be relatively moved with respect to the mixing part and the needle. The needle may be provided with a tapered section formed such that its outer width is gradually decreased toward the nozzle. The needle may be provided in the mixing part.

A needle supporting unit or support configured to support the needle may be provided at the mixing part. The nozzle drive unit may include a male screw portion formed at the nozzle; a female screw portion provided at the ejector body, and screw-coupled to the male screw portion; and a nozzle drive motor configured to rotate the nozzle.

A partitioning unit or partition, protruding in a radial direction of the suction part and configured to partition an inner space of the suction part into a high pressure refrigerant suction region and a low pressure refrigerant suction region, may be formed at the suction part. The nozzle may include a tapered section formed such that a flow sectional area is gradually decreased. An insertion opening configured to insert the nozzle in a relatively moveable manner may be formed at the partitioning unit. The female screw portion may be formed on an inner surface of the insertion opening.

A high pressure refrigerant suction opening configured to suction the high pressure refrigerant may be formed at the high pressure refrigerant suction region. A low pressure refrigerant suction opening configured to suction the low pressure refrigerant may be formed at the low pressure refrigerant suction region. The nozzle may be disposed such that one side thereof may communicate with the high pressure refrigerant suction region, to suction in the high pressure refrigerant. A diffuser formed such that a flow sectional area of the refrigerant is gradually increased may be provided at one side of the mixing part.

Embodiments disclosed herein further provide a refrigeration cycle apparatus having an ejector that may include a compressor configured to compress a refrigerant; a high pressure side heat exchanger connected to the compressor, and configured to cool a high pressure refrigerant; a gas-liquid separator connected to the compressor, and configured to separate a refrigerant which exists therein into a gas phase and a liquid phase; an evaporator connected to the gas-liquid separator, and configured to evaporate a refrigerant as the refrigerant absorbs latent heat; and an ejector having one or a first side connected to the high pressure side heat exchanger and having another or a second side connected to the evaporator. The refrigeration cycle apparatus having an ejector may further include a throttle valve provided between the evaporator and the gas-liquid separator, and configured to control a flow sectional area of a liquid refrigerant.

The refrigeration cycle apparatus having an ejector may further include a driving mode selection unit or selector configured to select a drive mode; and a controller configured to control the nozzle drive unit based on a drive mode selected by the drive mode selection unit. When a refrigerant compression ratio is increased, the controller may control the nozzle drive unit such that a diameter of a discharge side end of the nozzle (flow sectional area) may be reduced.

Embodiments disclosed herein further provide an ejector that may include an ejector body having a suction part or portion into which a high pressure refrigerant and a low pressure refrigerant may be suctioned, and having a mixing part or portion provided at one side of the suction part and configured to mix the high pressure refrigerant with the low pressure refrigerant; a nozzle provided in the suction part so as to be moveable, and configured to inject the high pressure refrigerant; a needle inserted into an end of the nozzle and configured to control a flow sectional area of the nozzle; a nozzle driving unit or drive configured to drive the nozzle so as to be relatively moved with respect to the mixing part; and a needle drive unit or drive configured to drive the needle so as to be relatively moved with respect to the mixing part. Each of the suction part and the nozzle may be provided with a tapered section formed such that a flow sectional area of a refrigerant may be gradually decreased in a discharge direction of the high pressure refrigerant. The needle may be provided at the mixing part, and may be provided with a tapered section formed such that its outer width may be gradually decreased toward the nozzle.

A partitioning unit or partition, protruding in a radial direction of the suction part and configured to partition an inner space of the suction part into a high pressure refrigerant suction region and a low pressure refrigerant suction region, may be formed at the suction part. An insertion opening configured to insert the nozzle in a relatively moveable manner may be formed at the partitioning unit, and the nozzle may be inserted into the insertion opening so as to be communicated with the high pressure refrigerant suction region, to suction of the high pressure refrigerant thereinto.

The nozzle driving unit may include a male screw portion formed on an outer surface of the nozzle; a female screw portion provided on an inner surface of the insertion opening, and screw-coupled to the male screw portion; and a nozzle drive motor configured to rotate the nozzle. The needle drive unit may include a lead screw disposed or that extends in a moving direction of the needle; a female screw portion screw-coupled to the lead screw; and a needle drive motor configured to rotate the lead screw. The needle drive unit may further include a power transmission unit or transmission configured to transmit power to the needle by connecting the female screw portion and the needle with each other.

Embodiments disclosed herein further provide a refrigeration cycle apparatus having an ejector that may include a compressor configured to compress a refrigerant; a high pressure side heat exchanger connected to the compressor, and configured to cool a high pressure refrigerant; a gas-liquid separator connected to the compressor, and configured to separate a refrigerant which exists therein into a gas phase and a liquid phase; an evaporator connected to the gas-liquid separator, and configured to evaporate a refrigerant as the refrigerant absorbs latent heat; and an ejector having one or a first side connected to the high pressure side heat exchanger and having another or a second side connected to the evaporator. The refrigeration cycle apparatus having an ejector may further include a throttle valve provided between the evaporator and the gas-liquid separator, and configured to control a flow sectional area.

The refrigeration cycle apparatus having an ejector may further include a drive mode selection unit or selector configured to select a drive mode, and a controller configured to control the nozzle drive unit and the needle drive unit based on a drive mode selected by the drive mode selection unit. When a refrigerant compression ratio is increased, the controller may control the nozzle driving unit such that the nozzle may be moved toward the mixing part, and may control the needle driving unit such that the needle may be moved in a direction that a diameter of a discharge side end of the nozzle (a flow sectional area) is reduced.

Further scope of applicability of the present application will become more apparent from the detailed description. However, it should be understood that the detailed description and specific examples, while indicating embodiments, are given by way of illustration only, since various changes and modifications within the spirit and scope will become apparent to those skilled in the art from the detailed description.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ejector, comprising:

an ejector body having a suction portion, into which a high pressure refrigerant and a low pressure refrigerant are suctioned, and a mixing portion provided at a first side of the suction portion and configured to mix the high pressure refrigerant with the low pressure refrigerant;

a nozzle movably provided in the suction portion, and configured to inject the high pressure refrigerant into the mixing portion, wherein the nozzle includes a nozzle body having a pipe shape with a predetermined inner diameter and a tapered section in which section a flow sectional area of the high pressure refrigerant is gradually decreased toward the mixing portion, the tapered section being formed at one side of the nozzle body;

a needle provided in the mixing portion and inserted into an end of the tapered section of the nozzle, and configured to control a flow sectional area of the nozzle; and a needle support configured to fixedly secure the needle to the ejector body; and a nozzle drive having a male screw portion formed at the nozzle, a female screw portion provided at the ejector body and screw-coupled to the male screw portion, and a nozzle drive motor configured to rotate the nozzle, wherein the suction portion is provided with a tapered section in which section a flow sectional area of the lower pressure refrigerant is gradually decreased toward the mixing portion, wherein the needle includes a tapered section, an outer width of which gradually decreases toward the nozzle, wherein the nozzle drive is configured to move the nozzle with respect to the mixing portion and the needle such that the flow sectional area of the low pressure refrigerant and the flow sectional area of the high pressure refrigerant are controlled simultaneously.

2. The ejector of claim 1, a wherein the needle support is configured to support the needle.

3. The ejector of claim 1, wherein a partition, which protrudes in a radial direction of the suction portion and is configured to partition an inner space of the suction portion into a high pressure refrigerant suction region and a low pressure refrigerant suction region, is formed at the suction portion.

4. The ejector of claim 3, wherein the partition includes an insertion opening configured to receive the nozzle in a relatively moveable manner, and wherein the female screw portion is formed on an inner surface of the insertion opening.

5. The ejector of claim 4, wherein a high pressure refrigerant suction opening configured to suction the high pressure refrigerant is formed at the high pressure refrigerant suction region, wherein a low pressure refrigerant suction opening configured to suction the low pressure refrigerant is formed at the low pressure refrigerant suction region, and wherein the nozzle is disposed such that one side thereof communicates with the high pressure refrigerant suction region, for suction of the high pressure refrigerant.

6. The ejector of claim 1, further including a diffuser, a flow sectional area of which gradually increases, provided at one side of the mixing portion.

7. A refrigeration cycle apparatus having an ejector, comprising;

a compressor;

a high pressure side heat exchanger connected to the compressor;

a gas-liquid separator connected to the compressor;

an evaporator connected to the gas-liquid separator; and the ejector of claim 1 having a first side connected to the high pressure side heat exchanger and a second side connected to the evaporator.

8. The refrigeration cycle apparatus of claim 7, further including a throttle valve provided between the evaporator and the gas-liquid separator.

9. The refrigeration cycle apparatus of claim 7, further including:

a drive mode selector configured to select a drive mode categorized according to a refrigerant compression ratio; and a controller configured to control the nozzle drive based on the drive mode selected by the drive mode selector.

10. The refrigeration cycle apparatus of claim 9, wherein when the refrigerant compression ratio is increased, the controller controls the nozzle drive such that a diameter or flow sectional area of a discharge side end of the nozzle is reduced.

* * * * *